United States Patent [19]

Reunanen

[11] 4,317,349

[45] Mar. 2, 1982

[54] METHOD AND APPARATUS FOR THE MANUFACTURE OF REINFORCEMENT SPIRALS

[75] Inventor: Kosti Reunanen, Lappi, Finland

[73] Assignee: Reunanen & Roviola Oy, Lappi, Finland

[21] Appl. No.: 110,101

[22] Filed: Jan. 7, 1980

[30] Foreign Application Priority Data

Jan. 9, 1979 [FI] Finland ..... 790046

[51] Int. Cl.[3] ..... B21F 3/04

[52] U.S. Cl. ..... 72/142

[58] Field of Search ..... 72/135, 137, 142, 145, 72/143, 168, 169, 183, 371

[56] References Cited

U.S. PATENT DOCUMENTS

| | | | |
|---|---|---|---|
| 1,923,898 | 8/1933 | Wahlberg | 72/135 X |
| 2,339,424 | 1/1944 | Poole | 72/145 |
| 3,566,654 | 3/1971 | Adams et al. | 72/135 |
| 3,996,779 | 12/1976 | Hawley | 72/142 |
| 4,114,432 | 9/1978 | Miura et al. | 72/135 |
| 4,145,904 | 3/1979 | Giros et al. | 72/142 |

FOREIGN PATENT DOCUMENTS

| | | | |
|---|---|---|---|
| 409983 | 5/1934 | United Kingdom | 72/135 |

*Primary Examiner*—Ervin M. Combs

*Attorney, Agent, or Firm*—Burns, Doane, Swecker & Mathis

[57] ABSTRACT

The invention relates to a method and apparatus for the manufacture of a screw-line shaped reinforcement spiral out of metal wire for the reinforcement of concrete pipes or columns. The wire is, while subject to tensile stress, wound onto a cylindrical last whose diameter is equal to the inner diameter of the spiral. The wire, before coming onto the last, passes over a roll that prestresses the wire to a curve of such a small diameter that, after the wire has been taken off the curve, a tension tending to bend the wire in the direction of bending of the reinforcement spiral remains in the wire. The winding takes place so that at the immediate proximity of the initial end of the last the wire passes over rolls. The first roll, whose projection is partly outside the projection of the mantle of the last and which gives the wire a curve radius smaller than the radius of the last, makes a tension bending in the wire in the direction of bending of the reinforcement spiral which bended remain in the wire. The subsequent rolls whose projections are inside the mantle of the last or are in contact with same, jointly provide a curvature whose curve radius is at the beginning larger than the radius of the last but becomes gradually smaller and, at the last roller becomes the same. The wire is wound onto the last as guided by rolls placed at the initial end of the last and positioned radially in relation to the last. The rolls provide the winding with an opening tension effective in the axial direction of the spiral, because the rise of the winding is at the beginning or at a part of the first winding, larger than the diameter of the wire but after a few windings, the rise is the same as the diameter of the wire. One or some of these last-mentioned windings are pressed against the last by means of a roll. The roll is, at the end of the roll facing towards the final end of the last, provided with a flange that penetrates between the windings and thereby causes gliding of the windings placed behind the flange on the last by the width of the flange and at the same time bending the windings in the axial direction of the spiral.

4 Claims, 2 Drawing Figures

METHOD AND APPARATUS FOR THE MANUFACTURE OF REINFORCEMENT SPIRALS

The present invention is concerned with a method and apparatus for the manufacture of a screw-line shaped reinforcement spiral out of metal wire for the reinforcement of concrete pipes or columns or equivalent.

Recently, unified screw-line shaped reinforcement spirals have started being used more and more extensively in the reinforcement of concrete pipes and columns instead of individual ring-shaped reinforcement units. The manufacture of unified reinforcement spirals, however, involves the difficulty that, having been removed from the manufacturing machine, they tend to open themselves to some extent, whereby the diameter of the spiral and the distances between the winds are changed to varying, arbitrary extents. It is an objective of the present invention to eliminate these drawbacks.

According to the present invention, the wire is, while subject to tensile stress, wound onto a cylindrical last whose diameter is equal to the inner diameter of the spiral and whereby the winding takes place so that at the immediate proximity of the beginning of the last, i.e. the end of the last at which the wire comes onto the last, the wire passes over rollers, rolls or the equivalent, of which the first one provides the wind of the spiral with such an initial curvature whose radius of curvature is smaller than the radius of the last and the subsequent ones jointly produce a curvature whose radius of curvature is at the beginning larger than that of the last but, however, gradually becomes smaller and, at the last roller or equivalent, becomes the same, by any tensions attempting to change the diameter of the spiral in the radial direction are neutralized in this way. The wire which is wound onto the last as guided by the rollers, rolls, etc. placed at the beginning of the last and positioned radially in relation to the last is given an opening tension acting in the axial direction of the spiral owing to the fact that the rise of the winding is at the beginning, and during a part of the first winding, larger than the diameter of the wire. After a few windings the rise is, equal to the wire diameter, which is ensured by pressing one or some of these windings against the last by means of a roll or equivalent which is, at the end towards the final end of the last, provided with a flange penetrating in between the windings and thereby causing gliding of the windings behind the flange on the last along the last the distance equalling the width of the flange. At the same time the flanged roll bends, bending the windings in the axial direction of the spiral so that the tensions produced at the beginning of the last and tending to open the windings in the axial direction are in this way neutralized.

By the method in accordance with the invention it is possible to manufacture a spiral which, when removed from the manufacturing device, does not at all, or at least not to a major extent, attempt to change the size and shape given to same on the last, neither in the radial nor in the axial direction of the spiral.

BRIEF DESCRIPTION OF THE DRAWINGS

The invention will be described below with reference to the attached schematical drawings. Wherein like members bear like reference numerals and wherein.

DETAILED DESCRIPTION OF THE PREFERRED EMBODIMENT

Figure 1:
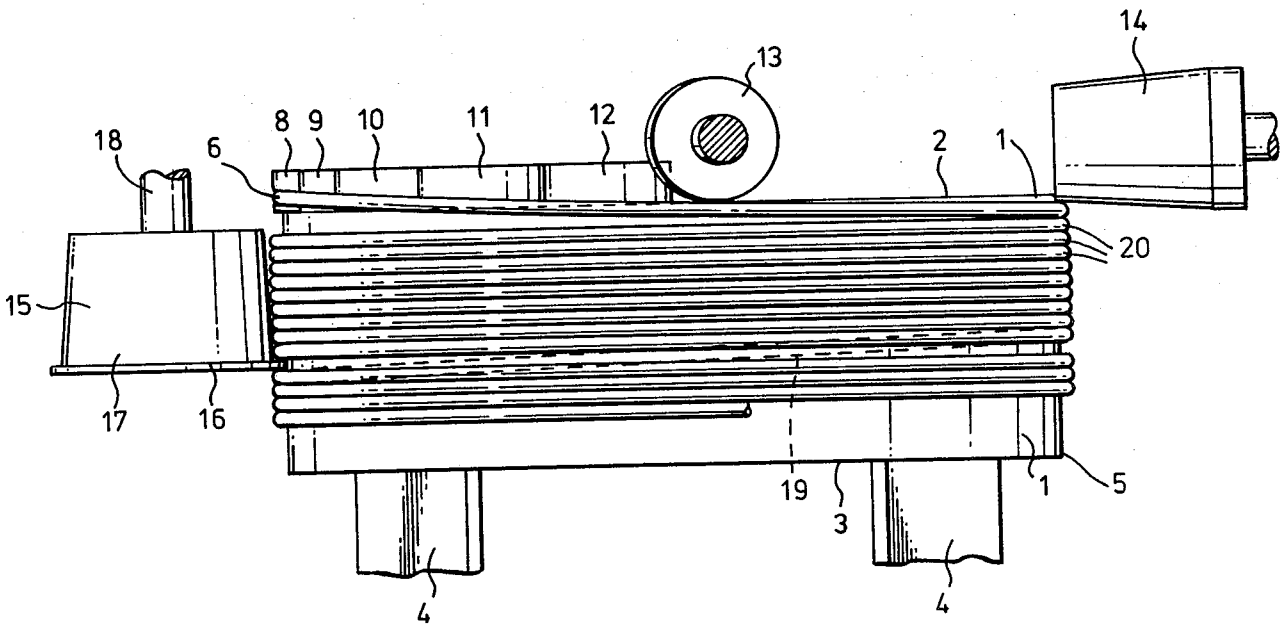
FIG. 1 is a schematic view of a device in accordance with the invention as viewed from the top.

With reference to FIG. 1 last 1 is a cylindrical object, which can be rotated on its axle and on its bearings (not shown in the drawing), e.g., by means of an electric motor (not shown in the drawing). The beginning of the last is designated by the end 2 in FIG. 1, and the final end is designated by the end 3. The final end is connected with bars parallel to the axle of the last, e.g. four angular-section irons 4 at uniform intervals close to the circumference 5 of the last. The extreme positions of the bars in the radial direction of the last are either right on the circumference 5 or close to same. The bars 4 support the completed spiral that is being pushed onto them from the last, which spiral is, having reached an appropriate length, at times removed from the bars 4 after the wire has been cut off.

Also, when the device is started, the beginning of the spiral wire is fastened to at least one rod 4, e.g. by means of a hook-shaped, slack curve bent to the end of the wire (not shown in the drawing), which curve is pushed along the rod towards its final end while the spiral is being pushed onto the rods.

Figure 2:
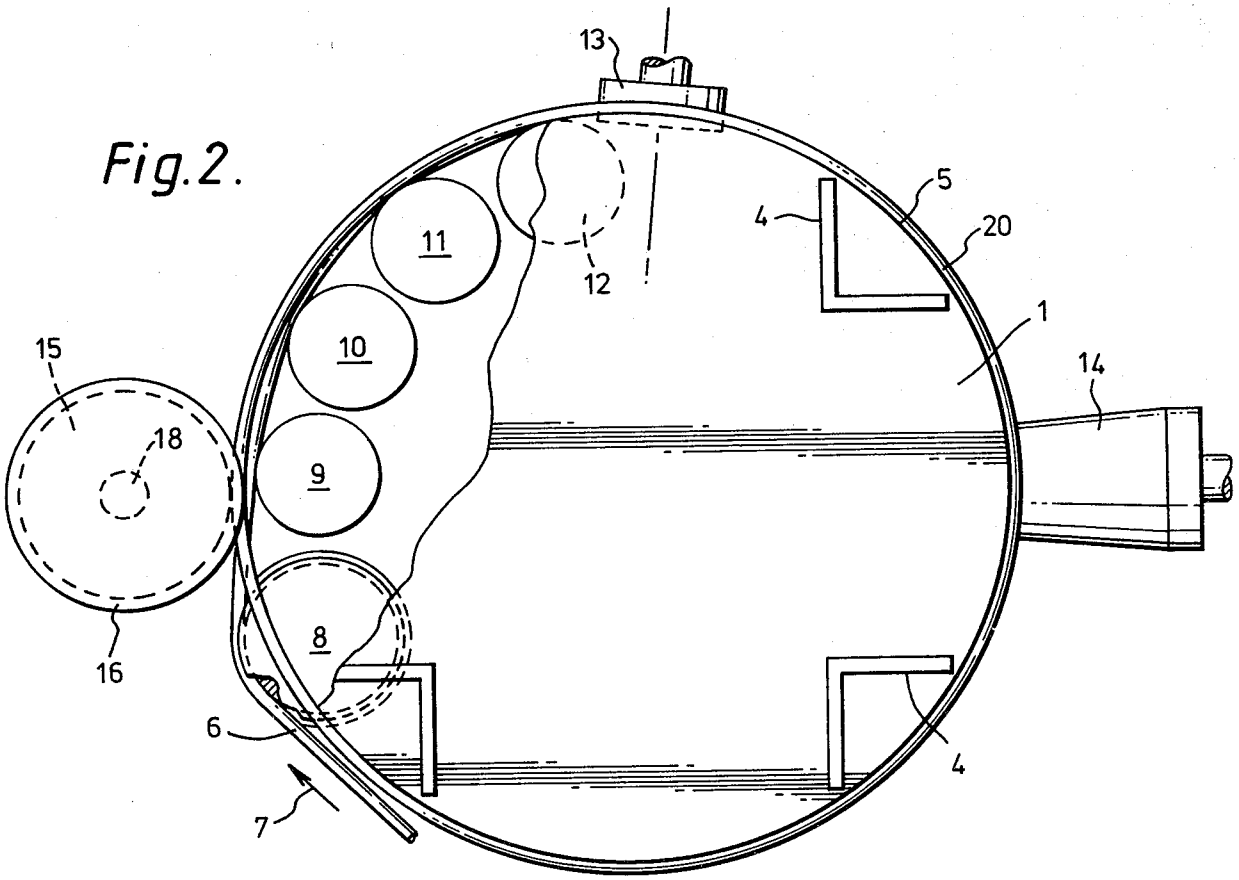
FIG. 2 is a schematic view of the device generally perpendicularly to the plane of viewing in FIG. 1, as viewed from the end.

After the device has been started in this way, more wire 6 is continually fed to the device diagonally from underneath the device, in the direction of the arrow 7 (FIG. 2), whereby the wire starts positioning itself onto the last as windings 20 shown in FIG. 1. The wire which is subject to tensile strain first passes over a grooved roll 8 placed in front of the initial end of the last, which roll bends the wire into a curve with a radius of curvature considerably smaller than that of the last. Thereupon the wire passes over the rolls 9, 10, 11, and 12 while contacting them. The entire roll 9 is inside the projection or imaginary extension of the mantle, i.e. the outer cylindrical surface of the last 1, and the circumference 5 shown in FIG. 2, as are the rolls 10, 11, and 12. However, the roll 12 contacts the said circumference 5 on the inside, and so does also possibly the roll 11, which is closer to the circumference than the roll 10 is, which roll 10 is again closer than the roll 9. In this way the radius of curvature of the wire is gradually again increased to the same size as the radius of the last. The wire passes from the roll 12 onto the last and is pushed by a roll 13, which is radial in relation to the last. Shifting of the windings 20 is further aided by a conical roll 14, radial in relation to the last.

At the latest by the time when the wire has proceeded to the roll 14, the wire has been pressed into contact with the wire of the preceding winding, but this may already be possible at the roll 13, depending on the adjustment of the mutual positions of the rolls 13 and 14. Also, the wire may, at roll 13, by the effect of the roll, just be curved to some extent towards the wire of the preceding winding, and in such a case it does not pass in the form of a straight line as shown in FIG. 1. In any case, by the effect of the rolls 6, 13, and 14, the rising angle of the first half of the winding, shown in FIG. 1, is larger than the rising angle of the following windings. For this reason a tension remains in the wire that tends to open the spiral produced on the last in its axial direction.

These tensions are removed by a roll 15. A flange 16 on the roll 15 does not allow the windings placed in front of the flange to open themselves in response to the tension. This opening is further avoided by the circumstance that the conical face 17 of the roll 15 in front of the flange presses the windings or the winding against the last, at least by the part of the roll nearest to the flange.

The axle 18 of the roll cannot move longitudinally in its bearing (the bearing is not shown in the drawings), which is fastened to a lever that is, by means of a spring, hydraulics, etc. (not shown in the drawings), pressed against the last. The flange 16 has then penetrated between the windings of the spiral, but does, not quite reach the last. Then the flange pushes the windings of the spiral behind it by the thickness of the flange towards the final end of the last toward the bars 4, thereby, according to FIG. 1, causing an opening of the spiral, shown by the broken line 19, underneath the last. This opening neutralizes the tension produced at the initial end of the last which tensions effective in the opposite direction, and tends to open the spiral in the axial direction.

The opening of the spiral shown by the broken line 19 appears to be relatively little on the drawing as compared with the opening in the opposite direction produced at the initial end of the last, but the relative proportion of these openings can, of course, be adjusted to the correct magnitude, e.g., by selecting a flange 16 of an appropriate thickness for the roll 15 or by adjusting the mutual positions of the rolls at the beginning of the last and of their position in relation to the last.

When, by means of the arrangement in accordance with the invention, described above, the rolls 8 to 12, which together with the roll 13 eliminate the tensions that might change the form of the spiral in its radial direction, are positioned so that the wire moves from them directly onto the last, in such a case no additional tensions of the axial type described above are produced between the roll 12 and the last. This would be possible if the wire came onto the last in such a direction that the wire, when coming to the last, would directly assume a position adjoining the preceding winding. In such a case the rolls would have to be placed radially outside the mantle face of the last. Between the point of arrival of the wire on the last and the point or departure of same from the nearest roll, the wire would again have to become straight, which would make the adjustment of the radial tensions concerned difficult. By the present invention, this drawback has been avoided. It is, however, necessary separately to adjust the tensions that maintain the form of the winding in the radial and axial direction, but in this way it is also easier to control their mutual relationship.

In the drawings, only the most essential features of the invention have been presented schematically. The device may, of course, include several additional devices not presented in the drawings.

For example, it is appropriate to produce a desired tensile strain on the wire by first, before entrance into the machine described above, passing the wire through a narrow hole in a so-called drawing stone, which hole presses the wire and produces a high friction and at the same time removes oxide scale from the surface of the wire.

Before coming onto the roll 8, after the drawing stone, the wire may be passed around a so-called prebending roll or groove wheel (not shown in the drawings) so that the wire has to curve almost 360° or at least more than 180° onto the circumference of the roll, which roll 8 has a considerably smaller radius than that of the last. Then an appropriate extent of tensions remain in the wire which facilitate its bending onto the last in the radial direction.

Also, the device may include automatic means that stop the spiral-information device after a desired number of windings have been wound, cut the wire automatically, remove the produced spiral, etc.

Spirals produced in this way, in which the windings remain in contact with each other after removal from the manufacturing machine, can be easily opened to the desired extent at the site of use of the spiral, e.g., by pulling at the ends, whereby the rises of the windings are opened uniformly and the spirals can thereby be fastened to the mould as of appropriate dimensions.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What we claim is:

1. A method for the manufacture of a screw-line shaped reinforcement spiral of metal wire for the reinforcement of concrete pipes or columns, comprising the steps of winding the wire, as the wire is subject to tensile stress, onto a cylindrical last whose diameter is equal to the inner diameter of the spiral, passing the wire, before coming onto the last, over a roll for prestressing the wire to a curve of such a small diameter that, after the wire has been taken off the roll, a tension tending to bend the wire in the direction of bending of the reinforcement spiral remains in the wire, the prestressing occurring at the immediate proximity of an intial end of the last by passing the wire over the roll whose outer peripheral surface extends radially outwardly beyond an imaginary extension of the outer cylindrical surface of the last, thereafter passing the wire over a plurality of subsequent rolls whose outer peripheral surfaces are positioned inside said extension of the last to jointly provide a curvature to the wire whose curve radius is at a first subsequent roll larger than the radius of the last but becomes gradually smaller and, at a last subsequent roll, is the same as the radius of the last whereby any tensions attempting to change the diameter of the spiral in the radial direction are neutralized, guiding the wire wound onto the last by radial rolls placed at the initial end of the last and positioned with their axes lying radially in relation to the last, said radial rolls provide the winding with an opening tension effective in the axial direction of the spiral since the rise of the winding is at the beginning, of a portion of the first winding larger than the diameter of the wire, pressing a portion of the windings against the last with a flanged roll, penetrating a flange which is arranged at an end of the flanged roll facing towards the final end of the last between the windings and thereby causing a gliding of the windings placed behind the flange on the last by the width of the flange and at the same time bending the windings in the axial direction of the spiral whereby the tensions produced at said initial end of the last and tending to open the spirals in the axial direction are eliminated.

2. An apparatus for the manufacture of a screw-line shaped reinforcement spiral of metal wire for the reinforcement of concrete pipes or columns, comprising a cylindrical last onto which the wire is wound into spiral form, a plurality of rolls arranged in immediate proximity of an initial end of the last in the axial direction of the last over which the wire must pass, the axis of each of the rolls being parallel to the axis of the last, a first one of the rolls over which the wire passes is positioned partially outside an imaginary extension of the outer cylindrical surface of the last in the radial direction, a following roll is positioned inside the said extension, each subsequent roll is positioned a lesser distance inside said extension than the preceding one until the outer peripheral surface of at least a last roll is in contact with said extension of the last from the inside, radial rolls arranged near said initial end of the last for guiding the wire to be wound onto the last so that after the first winding, whose rise includes at least a portion which is larger than that of the next winding, the windings are in contact with each other on the last during a few revolutions, a flanged roll for pressing a portion of the windings in contact with each other against the last, said flanged roll for pressing including a flange which penetrates between the windings, pushing the windings on a final portion of the last by the width of the flange towards a final end of the last.

3. The apparatus as claimed in claim 2, wherein a first one of the radial rolls feeding the wire onto the last at the initial end thereof is contacted by both the wire and the initial end of the last, and a point of a second radial roll which has the shape of a truncated cone becoming slightly wider outwards from the last is placed near the outer cylindrical surface of the last at said initial end at a distance approximately equal to the thickness of the wire from the initial end towards said final end of the last.

4. The apparatus as claimed in claim 2 or 3, wherein the outer surface of the flanged roll that presses the wire against the last has the shape of a truncated cone along an outer peripheral portion spaced from the flange.

* * * * *